US007373752B2

(12) United States Patent
Bubits

(10) Patent No.: US 7,373,752 B2
(45) Date of Patent: May 20, 2008

(54) PISTOL WITH A FIRING PIN SAFETY AND AN EJECTOR

(75) Inventor: Wilhelm Bubits, Brunn/Gebirge (AT)

(73) Assignee: Caracal International LLC, Abu Dhabi (AE)

( * ) Notice: Subject to any disclaimer, the term of this patent is extended or adjusted under 35 U.S.C. 154(b) by 273 days.

(21) Appl. No.: 10/547,656

(22) PCT Filed: Feb. 9, 2004

(86) PCT No.: PCT/AT2004/000040

§ 371 (c)(1),
(2), (4) Date: Sep. 1, 2005

(87) PCT Pub. No.: WO2004/081483

PCT Pub. Date: Sep. 23, 2004

(65) Prior Publication Data

US 2006/0265924 A1 Nov. 30, 2006

(30) Foreign Application Priority Data

Mar. 13, 2003 (AT) ..... A 396/2003

(51) Int. Cl.
*F41A 17/00* (2006.01)

(52) U.S. Cl. ..... 42/70.08

(58) Field of Classification Search ..... 42/70.08, 42/70.06

See application file for complete search history.

(56) References Cited

U.S. PATENT DOCUMENTS

| | | | | |
|---|---|---|---|---|
| 5,157,209 | A | 10/1992 | Dunn | |
| 5,437,120 | A * | 8/1995 | Dornaus | 42/70.08 |
| 5,502,914 | A | 4/1996 | Moon | |
| 5,625,971 | A * | 5/1997 | Tuma et al. | 42/70.08 |
| 6,263,607 | B1 | 7/2001 | Fuchs | |
| 6,349,495 | B1 * | 2/2002 | Fluhr | 42/70.08 |

* cited by examiner

*Primary Examiner*—Michael J. Carone
*Assistant Examiner*—Gabriel J Klein
(74) *Attorney, Agent, or Firm*—Greer, Burns & Crain, Ltd.

(57) ABSTRACT

A pistol with a firing pin includes a firing pin safety provided in the breech part. To afford a firing pin safety that is as simple and operationally safe as possible, a resilient tongue attached on an external side face of the breech part is provided, which resilient tongue forms a hook extending into the interior of the breech part, which hook comes to lie in front of a shoulder provided on the striker when the latter is in its cocked position, and the resilient tongue has a downwardly projecting web which cooperates with the trigger arm. The resilient tongue is integrally formed with an ejector spring.

6 Claims, 3 Drawing Sheets

PISTOL WITH A FIRING PIN SAFETY AND AN EJECTOR

BACKGROUND

The invention relates to a pistol having a longitudinally displaceable breech part containing a spring-actuated striker, with a lug cooperating with a trigger arm, firing pin safety provided in the breech part acting upon said striker, i.e. a pistol with firing pin firing, as opposed to pistols with hammer firing.

Besides their traditional safety which acts on the trigger mechanism, pistols also must have a firing pin safety which, for effectively increasing the safety, possibly should act at the final part of the chain of movement. In prior art pistols, for this purpose a spring-actuated rotating part is inserted in the slide, or in the breech part, respectively, which, for releasing the firing pin from the trigger arm, is pushed into an upper position by means of a vertically moved intermediate element.

What is disadvantageous is that the rotating part must be guided in the slide with narrow tolerance, which makes production more expensive, that the rotating part cannot act on a large area of the firing pin (little coverage), and that it has an unfavorable effect on the construction height of the slide.

From DE 197 02 374, a firing pin safety using a resilient tongue which cooperates with a shoulder of the striker is known. However, since this is a pistol with hammer firing, it is not comparable. First of all, the striker spring acts in the direction opposite to the firing pin spring of a pistol with striker firing. The resilient tongue does not cooperate with the trigger arm, and it engages on the rear end of the striker.

SUMMARY

Therefore, it is an object of the invention to provide a firing pin safety that is as simple, inexpensive, and operationally safe as possible for a pistol with firing pin firing, i.e. which has few and inexpensive parts that are easy to produce, and a large coverage for increasing the safety thereof.

According to the invention, this is achieved in that a resilient tongue attached on an external side face of the breech part is provided as the firing pin safety, which resilient tongue forms a hook extending into the interior of the breech part, which hook comes to lie in front of a shoulder provided on the striker when the latter is in its cocked position, and in that the resilient tongue has a downwardly projecting web which cooperates with the trigger arm. The resilient tongue is a simple member which is easy to mount from the outside, wherein no high requirements must be met with regard to tolerances. This member is a spring which in fact is fixedly connected to the breech part, thereby not requiring a tolerance-relevant guide. This also saves construction space which is beneficial to the dimensioning of the slide. Moreover, both the hook and the shoulder on the striker can be designed comparatively wide, resulting in a large coverage and, thus, a secure hold in the safe position.

As a further development of the invention, the trigger arm has a coulisse for cooperating with the web, which coulisse—when the trigger arm is moved in longitudinal direction—imparts a horizontal movement to the web and, thus, to the resilient tongue. Thus, the actuation of the firing pin safety is effected without a kinematic intermediate member. The coulisse on the firing arm and the lateral movement of the web allow for generous tolerances, thereby making the production considerably less expensive.

In a preferred embodiment, the resilient tongue is is a metal sheet member consisting of a foot portion fastened to the breech part, and a spring portion forwardly projecting therefrom in shooting direction, whose end forms the hook and whose web is in the vicinity of the hook, and on the striker, the lug is rearwardly arranged and the shoulder for engagement of the hook is arranged in front thereof. Thus, the resilient tongue can quite easily be produced as a punched member made of spring plate (that is, without requiring reworking by machine-finishing). This arrangement allows for a particularly favorable mode of construction of the entire pistol and also has functional advantages. First of all, the safety acts on the very front on the striker, i.e. in fact at the end of the chain of movement. By the fact that the web and the coulisse are arranged as far forwardly as the hook, the middle part of the resilient tongue can be restricted to its function as a bending spring; it is not subject to any other loads.

In a further development of the invention, also the trigger arm is a metal sheet member which, at its front end, is connected to the trigger lever and then extends approximately horizontally reardwardly, and which, at its rear end, forms the element which cooperates with the lug of the striker, the coulisse which cooperates with the web being located in front thereof. Thus, the trigger arm requires very little construction space, and the coulisse remains unaffected by the mostly also vertical movement of the rear end of the trigger arm that cooperates with the lug of the striker.

The invention also allows for a particularly attractive further development. It consists in that the resilient tongue is integrally formed with an ejector spring that acts on an ejector claw designed as a two-armed lever. The advantage which is achieved by uniting two construction elements into one is quite obvious. Add thereto that this not only does not entail any disadvantages, but that the inventive advantages benefit both elements. In a particularly smart realization, the ejector spring and the resilient tongue share the foot portion of the resilient tongue, and the ejector spring is formed above the resilient tongue. Thus, the combined spring is a completely simple punched member, so-to-speak one foot with two movable toes.

BRIEF DESCRIPTION OF THE DRAWINGS

In the following, the invention will be described and explained by way of illustrations of a preferred exemplary embodiment of a pistol according to the invention. Therein.

DETAILED DESCRIPTION

Figure 1:
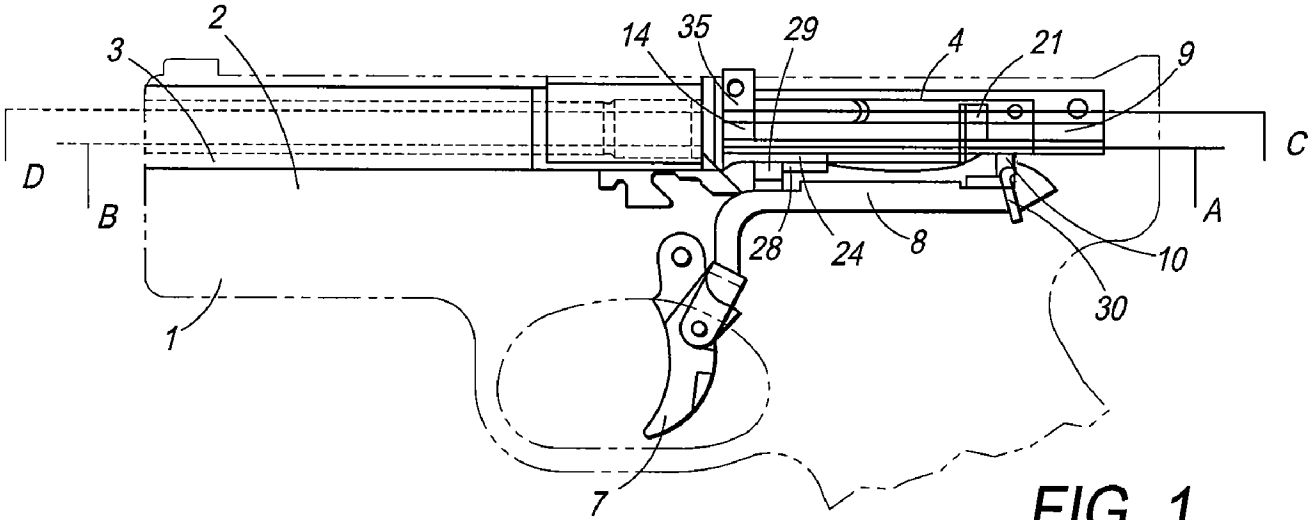
FIG. 1 is a side view in a first position.

In FIGS. 1, 2, 3 and 4, the pistol body 1 with slide 2 are merely schematically shown and therefore shown in broken lines. In the slide 2, there is a barrel 3 and a breech part 4 which is fixedly connected to the slide 2, such as by means of pins not illustrated, one of which passes through a bore 5 of the breech part 4. A round ready for firing is denoted by 6. A trigger 7 acts on a lug 10 of a striker 9 via a trigger arm 8, said striker being braced by a pressure spring not illustrated within the interior of the breech part 4, said pressure spring acting in shooting direction. Locking and guiding of the barrel and further features are not described as they are not essential to the invention.

The breech part 4 is approximately parallelepiped-shaped, having an upwardly open inner space 13 in which the striker 9 which also is approximately parallelepiped-shaped is located with its lug 10 that protrudes downwards from the breech part 4. The most forward part of the striker 9 is the firing pin 14 proper which acts on the round 6 through a bore in the front face 15. At the front of the striker where it merges into the firing pin 14, a shoulder 16 extending over the entire height of the striker 9 is provided. This shoulder 16 is engaged by the firing pin safety. It is formed by a spring tongue 20 which consists of a foot portion 21 externally fastened to the breech part 4, a spring portion 22, a downwardly projecting web 24 and a hook portion 23, the latter projecting into the inner space 13 through a lateral opening in front of the shoulder 16 of the striker 9. The foot portion 21 is located very far rearwardly on the breech part 4, the hook portion 23 and the web 24 are located far forwardly. The spring portion 22 is therebetween. As a whole, the spring tongue 20 is a punched member made of spring plate material.

The web 24 forms a coulisse 28 of ramp shape seen in horizontal section; in its front region, the trigger arm 8 has an upwardly projecting finger 29. The trigger arm may be a punched member made of metal sheet. In the position illustrated in FIG. 1, the trigger is just being pulled, the trigger edge 30 is just releasing the lug 10 of the striker 9, the finger 29 is starting to cooperate with the coulisse 28, it is pushing aside the web 24 and, together therewith, the hook portion 23 of the spring tongue 20, and the hook portion 23 is releasing the shoulder 16. The striker 9 can be rapidly driven forwards by the force of the pressure spring not illustrated.

Figure 2:
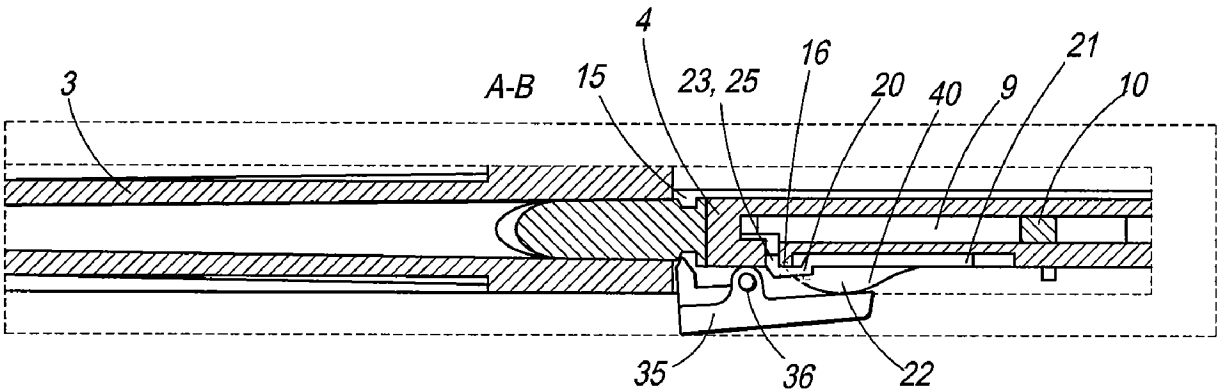
FIG. 2 is a horizontal section according to AB.
Figure 3:
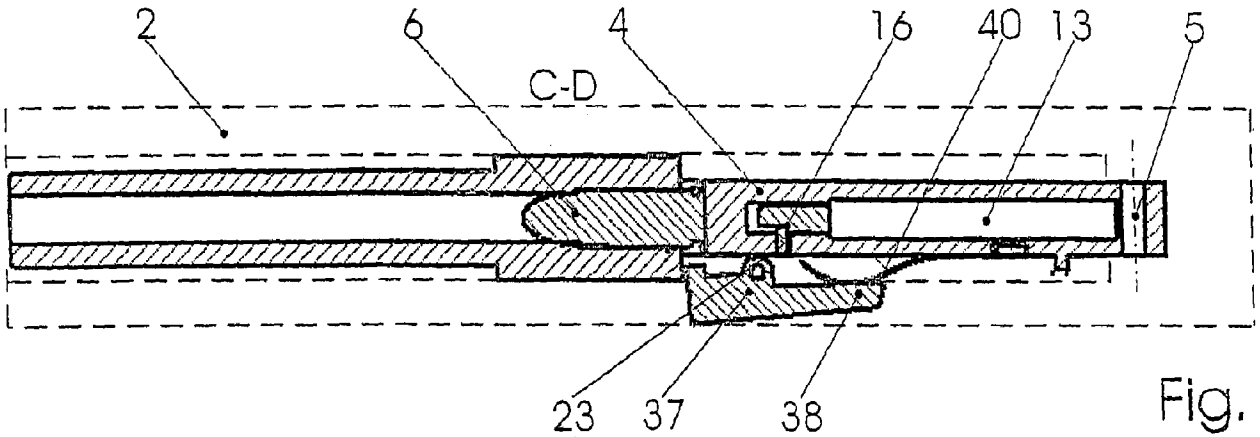
FIG. 3 is a horizontal section according to CD.
Figure 4:
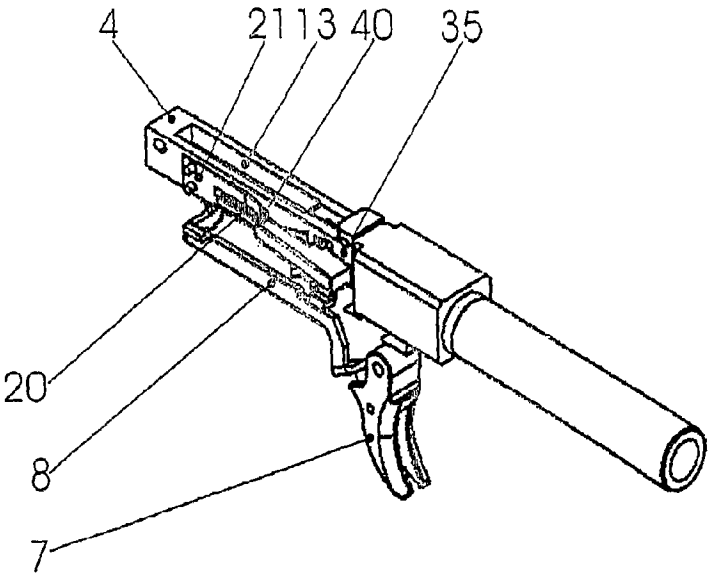
FIG. 4 is an axonometric view regarding FIG. 1.

In FIG. 2, and partly also in FIG. 4, the ejector claw 35 which is pivotable about an axis 36 is visible. It is a two-armed lever whose first arm, the head part 37, acts inwardly on the round 6, and whose second arm, the tail part 38, therefore must be pressed outwards by an ejector spring 40. The ejector spring 40 also is a punched member made of spring plate and shares the foot portion 21 with the resilient tongue 20. In other words, and visible in FIG. 4: the two springs 20 and 40 are one single punched member. From its foot portion 21 screwed or otherwise fastened to the breech part 4, two resilient fingers extend forwardly: at the bottom, the resilient tongue 20 which acts inwards with its hook portion, and thereabove the ejection spring 40 which acts outwards and on the tail portion 38 of the ejector claw.

Figure 5:
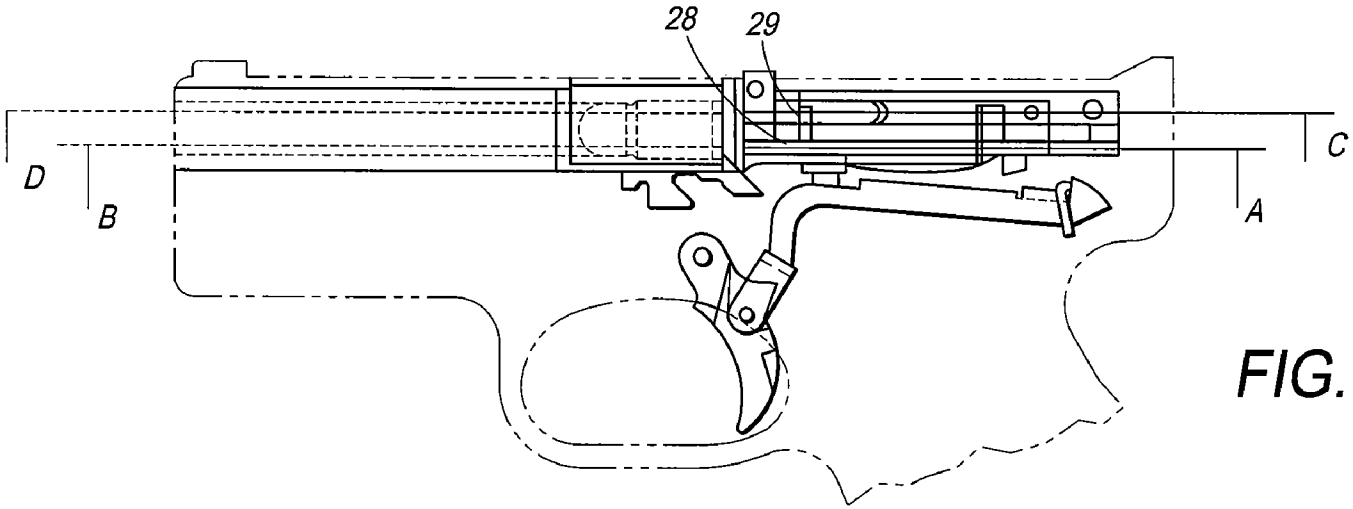
FIG. 5 is a side view in a second position.
Figure 6:
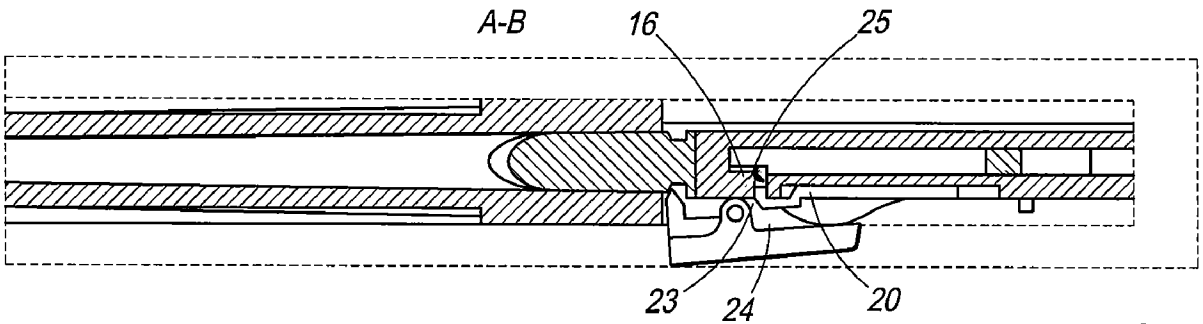
FIG. 6 is a horizontal section according to AB' of FIG. 5.

In FIGS. 5 and 6, the released firing pin is just about to impinge on the round 6 and to trigger the shot thereby. Subsequently, the breech part 4 will move back with the slide 2. The finger 29 of the trigger arm 8 is entirely ridden on the coulisse 28, and the web 24 has been pressed outwards. Thus, also the hook portion 23 has been completely retracted into the opening 25, and the shoulder 16 of the striker 9 is clear.

The invention claimed is:

1. A pistol with a shiftable breech part that contains a spring-actuated striker, with a lug cooperating with a trigger arm, a firing pin safety provided in the breech part acting upon said striker, comprising: a resilient tongue attached on an external side face of the breech part is provided as the firing pin safety, which resilient tongue forms a hook extending into the interior of the breech part, which hook comes to lie in front of a shoulder provided on the striker when the latter is in its cocked position, and in that the resilient tongue has a downwardly projecting web which cooperates with the trigger arm.

2. A pistol according to claim 1, wherein the trigger arm has a finger which cooperates with a coulisse of the web when the trigger arm moves in longitudinal direction.

3. A pistol according to claim 1, wherein the resilient tongue is a metal sheet member which consists of a foot portion fastened to the breech part, and a spring portion projecting forwardly from the foot portion in shooting direction, whose end forms the hook and whose web is in the vicinity of the hook, and in that on the striker, the lug is rearwardly arranged and the shoulder for the engagement of the hook is arranged in front thereof.

4. A pistol according to claim 3, wherein the trigger arm is a metal sheet member which, on its forward end, is connected to the trigger lever and then extends approximately horizontally rearwardly, and which, on its rear end, forms an element which cooperates with the lug of the striker, further including a coulisse that cooperates with the web being arranged in front of said lug of the striker.

5. A pistol according to claim 3, wherein the resilient tongue is integrally formed with an ejector spring which acts on an ejector claw that is formed as a two-armed lever.

6. A pistol according to claim 5, wherein the ejector spring and the resilient tongue share the foot portion of the resilient tongue, and the ejector spring is provided above the resilient tongue.

* * * * *